US005163506A

United States Patent [19]

Attinger et al.

[11] Patent Number: 5,163,506

[45] Date of Patent: Nov. 17, 1992

[54] COOLING WATER EXPANSION TANK

[75] Inventors: Thomas Attinger, Stuttgart; Wolfgang Kleineberg, Calw, both of Fed. Rep. of Germany

[73] Assignee: Mercedes-Benz AG, Fed. Rep. of Germany

[21] Appl. No.: 846,345

[22] Filed: Mar. 5, 1992

[30] Foreign Application Priority Data

Mar. 6, 1991 [DE] Fed. Rep. of Germany ..... 4107183

[51] Int. Cl.[5] ..... F01P 11/02

[52] U.S. Cl. ..... 165/104.32; 123/41.54; 165/917

[58] Field of Search ..... 165/104.32, 917; 123/41.54, 41.51, 41.27

[56] References Cited

U.S. PATENT DOCUMENTS 4,640,235 2/1987 Martin ..... 165/104.32
4,776,390 10/1988 Crofts ..... 165/104.32

FOREIGN PATENT DOCUMENTS 0177860 4/1986 European Pat. Off. .
1254908 11/1967 Fed. Rep. of Germany .
3007272 7/1983 Fed. Rep. of Germany .
3517715 11/1986 Fed. Rep. of Germany .
1488484 10/1977 United Kingdom .
1488512 10/1977 United Kingdom .

*Primary Examiner*—Albert W. Davis, Jr.
*Attorney, Agent, or Firm*—Evenson, Wands, Edwards, Lenahan & McKeown

[57] ABSTRACT

A cooling water expansion tank having a level-fixing device which prevents cooling water from running out when the filling pipe is opened after driving operation and when filling the expansion tank. The level-fixing device has a positive pressure valve which is located in the vent conduit and is closed during filling. The filling pipe is provided with an overflow edge which is at least at the same height as the cooling water level at maximum expansion height.

3 Claims, 1 Drawing Sheet

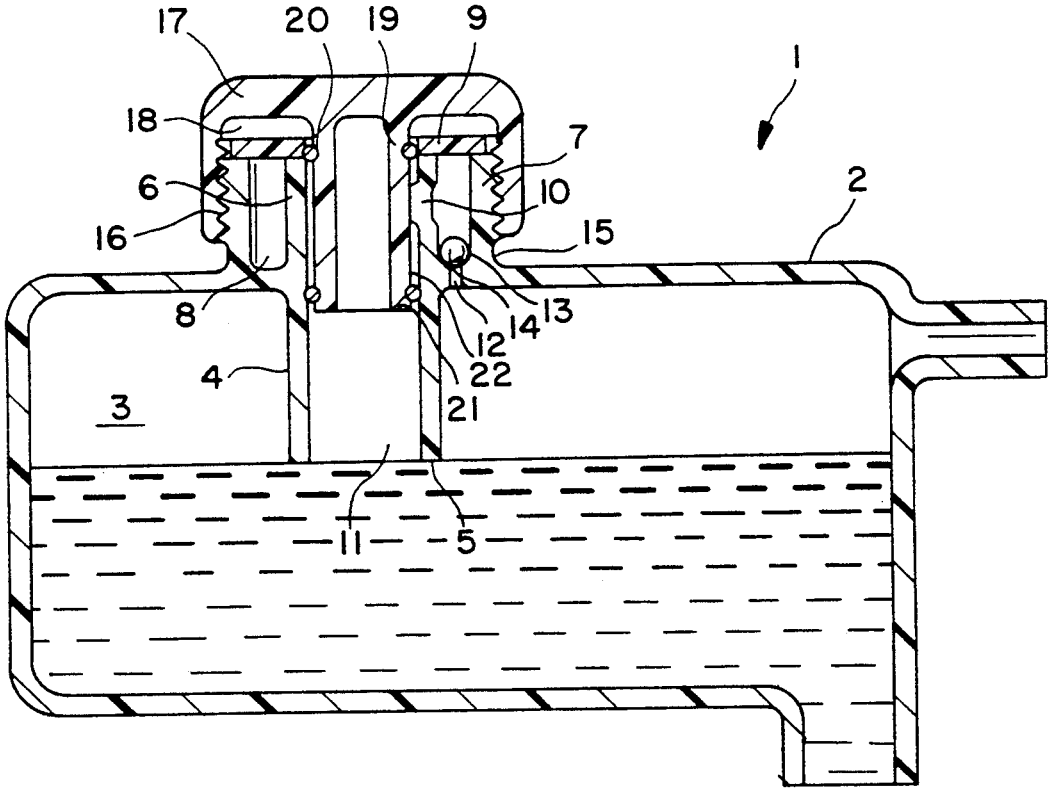
17
20
19
9
1
18
7
6
10
2
16
15
8
13
14
12
22
4
21
3
11
5

COOLING WATER EXPANSION TANK

BACKGROUND AND SUMMARY OF THE INVENTION

The present invention relates to a cooling water expansion tank having a level-fixing device that is a positive pressure valve which controls a vent conduit which, starting from a tank top, emerges into the filling duct of a filling stub-pipe which can be closed by a cap. The filling duct has, for limiting the level, a lower edge located in the internal space of the tank and at a distance from the tank top, and sealed boundaries located between the cap and the tank. These sealed boundaries are provided in the vent path and shut off the vent conduit from the tank internal space and from the atmosphere when the cap is closed.

A cooling water expansion tank of the above-described type is described in German Patent Document DE-PS 30 07 272. In this tank, an overflow conduit leading to the outside is located on a filling pipe which can be closed by a cap to fix the level in the expansion tank. The filling pipe is attached to a side wall of the expansion tank. During driving operation, the cooling water becomes heated and expands into the air space, located above the water level, of the closed expansion tank. The heated cooling water is then held back from running out via the overflow conduit by a seal between the cap and the filling pipe. When the cap is opened, however, the seal is removed so that the cooling water can flow away unhindered via the overflow conduit until the cooling water level has fallen below the lower edge of the overflow conduit. This has the disadvantage that when the cooling water has previously expanded over the lower edge of the overflow conduit, cooling water is extracted from the expansion tank and therefore from the cooling circuit on every opening procedure and this reduces the cooling capability. In addition, the adjustment of the level on filling the expansion tank leads to a loss of cooling water, requiring continuous filling during the adjustment of the level until the cooling water emerges from the overflow conduit.

An object of the present invention is to provide a cooling water expansion tank in which the cooling water does not run out when the filling pipe is opened after a driving operation or when the expansion tank is filled.

This and other objects are achieved by the present invention which provides a cooling water expansion tank arrangement having a tank with a tank top and an internal space, a level-fixing device including a vent conduit and a positive pressure valve, a filling stub-pipe having a filling duct with a lower edge located in the internal space of the tank and at a distance from the tank top, a cap which closes the filling stub-pipe, a vent space between the filling stub-pipe and the cap, a vent conduit between the vent space and the tank top, the vent conduit receiving a positive pressure valve, a first sealed boundary between the vent space and the atmosphere and a second sealed boundary between the vent space and the internal space of the tank, the sealed boundaries limiting the vent space. The sealed boundaries shut off the vent conduit from the tank internal space and from the atmosphere when the cap closes the filling stub-pipe. The first sealed boundary is open and the second sealed boundary is closed when the cap is only partially opened.

The opening characteristic of the positive pressure valve is such that it only opens when the pressure occurring on filling the expansion tank slightly exceeds a positive pressure specified at the positive pressure valve. Consequently, the expansion tank can be filled up to the lower edge of the filling pipe, as far as the upper edge of its mouth in the case of a filling pipe which protrudes obliquely. This ensures that the level is fixed and creates an air space with a slight positive pressure located above the liquid surface. The cooling water can expand into this air space when it becomes hot during driving operation. If further filling occurs, the level rises in the filling pipe only.

For an embodiment of a filling pipe having low design height attached to the side of the expansion tank, it is possible that in the expanded condition, the cooling water level in the expansion tank is so far above the overflow edge of the filling pipe that cooling water runs out of the filling pipe when the cap is removed—despite venting of the tank—because of level equalization between the expansion tank and the filling pipe. In order to avoid this in the compensation tank, an embodiment of the present invention provides an overflow edge on the filling pipe, this overflow edge being at least at the same height as the cooling water level at maximum expansion height.

In another embodiment of the present invention, the filling pipe is located in the top of the expansion tank. A wall piece of the filling pipe protruding out of the tank forms, together with the tank top, an annular disk and a pipe piece, a hollow space which has, as vent conduit, openings to the internal space of the tank (in the top) and to the inside of the filling pipe. Because of the arrangement of the filling pipe in the tank top and the structural utilization of the wall piece and the tank top to form a vent conduit, complicated external conduit lines are omitted.

Other objects, advantages and novel features of the present invention will become apparent from the following detailed description of the invention when considered in conjunction with the accompanying drawings.

BRIEF DESCRIPTION OF THE DRAWINGS

The single drawing figure shows a longitudinal sectional view of a cooling water expansion tank constructed in accordance with an embodiment of the present invention and having a filling pipe with cap, a vent conduit and a ball valve, used as a positive pressure valve, located in the vent conduit.

DETAILED DESCRIPTION OF THE DRAWINGS

An expansion tank 1 illustrated in the drawing figure, has in its top 2, a filling stub-pipe 4 protruding into the tank internal space 3. The filling stub-pipe 4 forms a level limitation device by means of its lower edge 5 located in the tank internal space 3 and at a distance from the tank top 2.

An upper section 6 of the filling stub-pipe 4 protruding from the tank 1 is concentrically surrounded by a ring wall 7 connected to the tank top 2 so as to form an annular space 8 which is closed towards the top by an annular disk 9. The annular space 8 is connected via a hole 10 in the filling stub-pipe 4 to its filling duct 11 and, is also connected via a hole 12 in the tank top 2 to the tank internal space 3. The annular space 8, the hole 10 and the hole 12 form a vent conduit from the tank internal space 3 to the atmosphere.

In the region of the hole 12, a conical valve seat 13 is provided in the annular space 8 for a positive pressure valve which controls the vent conduit. The positive pressure valve is configured as a ball valve whose ball 14 is in contact with the valve seat 13 and closes the hole 12.

The ring wall 7 has, on its outside 15, a screw thread 16 onto which is screwed a cap 17 when the tank 1 is closed. On its inside 18, the cap 17 has a central stub-pipe 19 with which two sealing rings 20, 21 at a distance from one another and forming sealed boundaries are in contact with filling stub-pipe 4.

In the vent path, the vent conduit is shut off from atmosphere by the sealing ring 20 and from the tank internal space 3 by the sealing ring 21 when the cap 17 is closed. The sealing rings 20, 21 delimit, in the filling duct 11 of the filling stub-pipe 4, a vent space 22 into which the vent conduit emerges.

When the expansion tank 1 is being filled, the weight of the ball 14 is just sufficiently great for the hole 12 to remain closed against the resulting pressure of the displaced air. By this means, the expansion tank 1 can only be filled as far as the lower edge 5 of the filling stub-pipe 4. With further filling, any further rise in the liquid surface occurs only in the filling duct 11 of the filling stub-pipe 4 so that, in the expansion tank 1, a level is fixed during filling which depends on the position of the lower edge 5.

During driving operation, the cooling water expands so that the liquid surface rises in the expansion tank 1 and compresses the air. At a certain system pressure, which depends on the weight of the ball 14, the ball is raised so that a pressure balance takes place between the tank internal space 3 and the vent space 22.

On opening of the expansion tank 1 after driving operation, the sealing ring is located outside the filling stub-pipe 4 after a few rotations of the cap 17, i.e. with the cap partially open, so that pressure balance takes place between the tank internal space 3 and atmosphere by the escape of air under pressure via the vent conduit, the vent space 22 and the thread 16.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A cooling water expansion tank arrangement comprising:

a tank having a tank top and an internal space;

a level-fixing device including a vent conduit and a positive pressure valve;

a filling stub-pipe having a filling duct with a lower edge located in the internal space of the tank and at a distance from the tank top;

a cap which closes the filling stub-pipe;

a vent space between the filling stub-pipe and the cap;

a vent conduit between the vent space and the tank top, the vent conduit receiving a positive pressure valve;

a first sealed boundary between the vent space and the atmosphere and a second sealed boundary between the vent space and the internal space of the tank, said sealed boundary limiting the vent space;

wherein said sealed boundaries shut off the vent conduit from the tank internal space and from the atmosphere when the cap closes the filling stub-pipe, and the first sealed boundary is open and the second sealed boundary is closed when the cap is only partially opened.

2. Cooling water expansion tank according to claim further comprising a valve seat for the positive pressure valve in the region of the hole in the annular space.

3. Cooling water expansion tank according to claim 2, wherein the positive pressure valve is a ball valve.

* * * * *